US009372011B2

(12) United States Patent
Chen et al.

(10) Patent No.: US 9,372,011 B2
(45) Date of Patent: Jun. 21, 2016

(54) HEAT EXCHANGER AND GAS-FIRED FURNACE COMPRISING THE SAME

(71) Applicant: GD MIDEA HEATING & VENTILATING EQUIPMENT CO., LTD., Beijiao (CN)

(72) Inventors: Chaojing Chen, Beijiao (CN); Jianmin Zhang, Beijiao (CN); Junhua He, Beijiao (CN); Feihang Li, Beijiao (CN)

(73) Assignee: GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 297 days.

(21) Appl. No.: 14/095,242

(22) Filed: Dec. 3, 2013

(65) Prior Publication Data

US 2014/0174424 A1 Jun. 26, 2014

(30) Foreign Application Priority Data

Dec. 24, 2012 (CN) ..... 2012 1 0571757

(51) Int. Cl.

| | |
|---|---|
| ***F28D 1/04*** | (2006.01) |
| ***F24H 3/08*** | (2006.01) |
| ***F28F 13/08*** | (2006.01) |
| ***F28D 7/08*** | (2006.01) |
| ***F28D 7/16*** | (2006.01) |

(52) U.S. Cl.

CPC ..... *F24H 3/087* (2013.01); *F28D 7/087* (2013.01); *F28D 7/1607* (2013.01); *F28F 13/08* (2013.01)

(58) Field of Classification Search

CPC ... F28D 1/0417; F28D 1/05308; F28D 3/087; F28D 7/1607; F28D 7/087; F28D 1/05316; F28D 1/05325; F28D 1/05333; F28D 1/0534; F28F 13/08

See application file for complete search history.

(56) References Cited

U.S. PATENT DOCUMENTS 7,175,426 B2 * 2/2007 Bolind ..... C04B 11/028 106/722
2012/0247444 A1 * 10/2012 Sherrow ..... F24H 9/14 126/116 R

* cited by examiner

*Primary Examiner* — Alfred Basichas
(74) *Attorney, Agent, or Firm* — Hodgson Russ LLP

(57) ABSTRACT

A heat exchanger and a gas-fired furnace including the same are provided. The heat exchanger includes at least two heat exchange shell enclosures; and at least three rows of heat exchange tubes arranged along a furnace air flow path. Each of the heat exchange tubes defines a leaving-tube-end and an entering-tube-end, two adjacent rows are spaced from each other, the at least three rows of heat exchange tubes are connected in a leaving-tube-end to entering-tube-end fashion sequentially via the at least two heat exchange shell enclosures to define a substantially serpentine flue gas passage.

20 Claims, 6 Drawing Sheets

HEAT EXCHANGER AND GAS-FIRED FURNACE COMPRISING THE SAME

CROSS-REFERENCE TO RELATED APPLICATION

This application claims priority to and benefits of Chinese Patent Application Serial No. 201210571757.7, filed with the State Intellectual Property Office of P. R. China on Dec. 24, 2012, the entire content of which is incorporated herein by reference.

BACKGROUND

1. Technical Field

Embodiments of the present invention relate to a heat exchanger and a gas-fired furnace comprising the heat exchanger.

2. Description of the Related Art

A forced hot air, gas-fired furnace in the related art generally comprises a burner, a heat exchanger, a secondary coil, a flue gas inducer and an air ventilation fan.

The heat exchangers in hot air, gas-fired furnaces may typically be categorized into two types: one type is known as tubular type heat exchanger and the other as clamshell type heat exchanger. The tubular type heat exchanger is fabricated by bending an aluminized steel tube into a serpentine shape having a plurality of straight segments and curved segments and then fixing parallelly a plurality of serpentine tubes on endplates. For the tubular type heat exchanger, due to the needs to satisfy the gas combustion space and heat transfer surface area requirements, the tube diameter is generally configured to be sufficiently large. Furthermore, for the portion of tube bend, tube metal experiences lattice stretching at the outer bend surface and a compression at the inner bend portion. The bend radius must be large enough to avoid excessively stretching or compressing the tube metal. Therefore, it is difficult to achieve the compactness of a tubular heat exchanger design in order to reduce the height of the gas-fired furnace, resulting in poor cost-effectiveness in shipping the gas-fired furnace and installation of the gas-fired furnace. The clamshell type heat exchanger is fabricated by connecting a plurality of clamshells side by side to the heat exchanger endplates. Two mating clamshells define a flue gas passage, which requires a long design cycle to achieve the optimized clamshell surfaces in terms of effective heat transfer, thermal stress management, and manufacturability. The costs associated with tooling and manufacturing equipment are high.

SUMMARY

Embodiments of the present invention provide a heat exchanger. The heat exchanger comprises at least two heat exchange shell enclosures; and at least three rows of heat exchange tubes arranged along a furnace air flow path, each of the heat exchange tubes defines a leaving-tube-end and an entering-tube-end. Two adjacent rows are spaced from each other, the at least three rows of heat exchange tubes are connected in a leaving-tube-end to entering-tube-end fashion sequentially via the at least two heat exchange shell enclosures to define a substantially serpentine flue gas passage.

Embodiments of the present invention also provide a gas-fired furnace. The gas-fired furnace comprises a furnace body; a burner disposed in the furnace body; a heat exchanger connected with an outlet of the burner. The heat exchanger comprises at least two heat exchange shell enclosures; at least three rows of heat exchange tubes arranged along a furnace air flow path, wherein each of the heat exchange tubes defines a leaving-tube-end and an entering-tube-end, two adjacent rows are spaced from each other, the at least three rows of heat exchange tubes are connected in a leaving-tube-end to entering-tube-end fashion sequentially via the at least two heat exchange shell enclosures to define a substantially serpentine flue gas passage; a secondary coil connected with the heat exchanger; an air ventilation fan disposed below the secondary coil; and a flue gas inducer disposed at a side of the secondary coil.

DETAILED DESCRIPTION OF EMBODIMENT(S)

Figure 1:
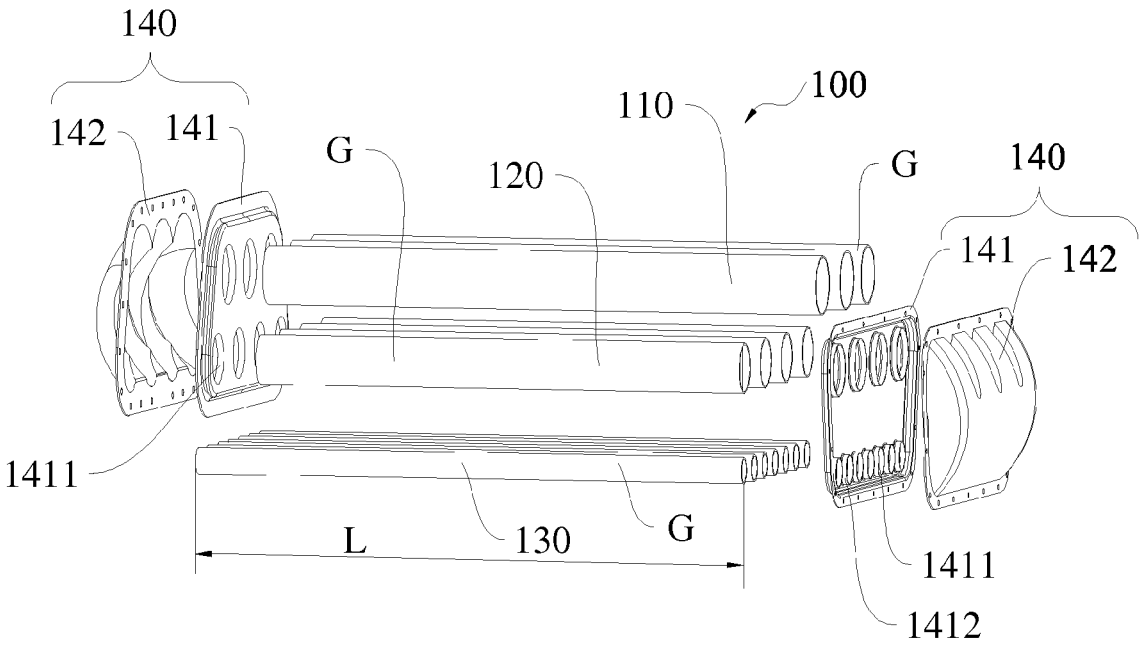
FIG. 1 is a schematic exploded view of a heat exchanger according to an embodiment of the present invention.

Embodiments of the present invention will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present invention. The embodiments shall not be construed to limit the present invention.

The heat exchanger according to embodiments of the present invention will be described below with reference to the drawings. By way of example and without limitation, the heat exchanger according to embodiments of the present invention may be used in a gas-fired furnace. For the sake of clarity, in the following description, the heat exchanger used for the gas-fired furnace is taken as an example for explanation.

Figure 2:
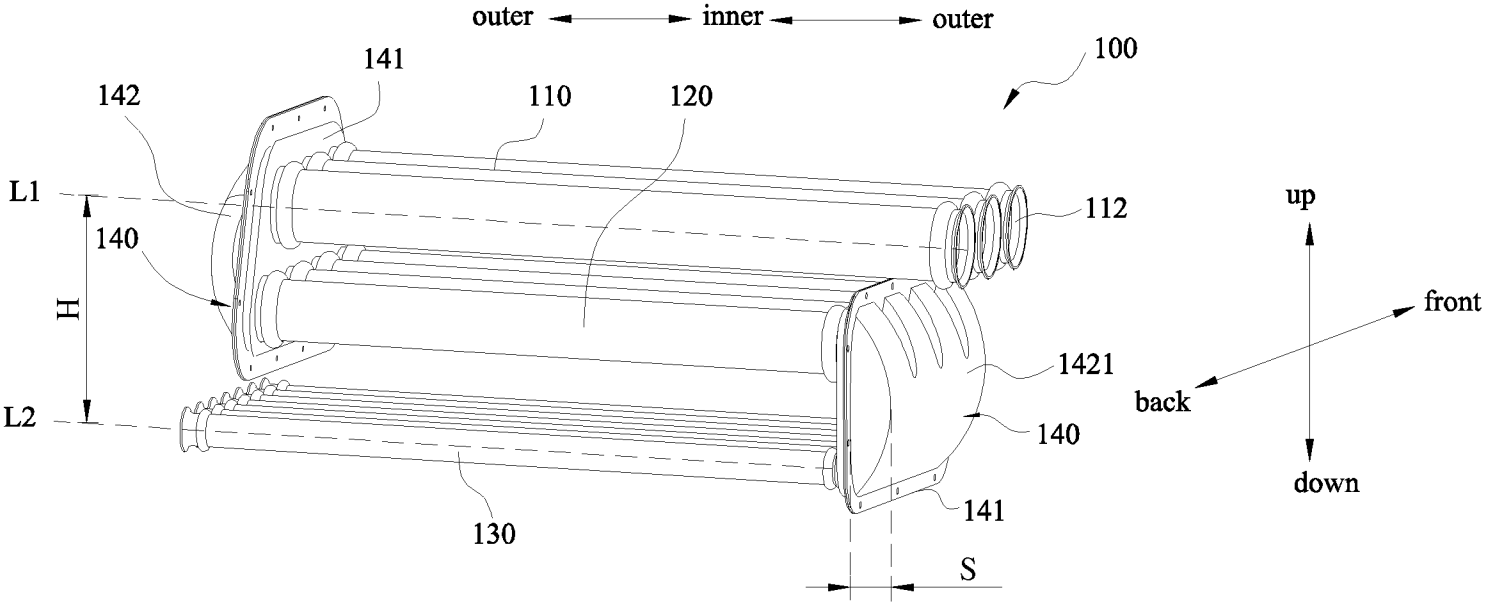
FIG. 2 is a schematic assembly view of a heat exchanger according to an embodiment of the present invention.

As shown in FIGS. 1-2, the heat exchanger 100 according to embodiments of the present invention includes at least three rows of heat exchange tubes G and at least two heat exchange shell enclosures 140. The at least three rows of heat exchange tubes G are arranged along a furnace air flow path. Each of the heat exchange tubes G defines a leaving-tube-end and an entering-tube-end, two adjacent rows are spaced from each other, the at least three rows of heat exchange tubes G are connected in a leaving-tube-end to entering-tube-end fashion sequentially via the at least two heat exchange shell enclosures 140 so as to define a substantially serpentine flue gas passage. That is, the heat exchanger tube G in one row is connected with the heat exchanger tube G in next row in a leaving-tube-end to entering-tube-end fashion. In other words, inner cavities of the at least three rows of the heat exchange tubes G and inner cavities of the at least two exchange shell enclosures 140 form the substantially serpentine flue gas passage.

In some embodiments, the heat exchange tubes G are generally parallel to each other, and the heat exchange tubes G in two adjacent rows are disposed in a staggered fashion.

With the heat exchanger according to embodiments of the present invention, by connecting the at least three rows of heat exchange tubes leaving-tube-end to entering-tube-end sequentially via the heat exchange shell enclosures, the heat exchanger can have a more compact structure, resulting in low profile, ease of manufacturing, and reduction of total costs.

In some embodiments, as shown in FIGS. 1-2 and 7-8, by way of example and without limitation, the heat exchanger 100 includes three rows of heat exchange tubes G and two heat exchange shell enclosures 140. Each row includes a plurality of heat exchange tubes G arranged parallel to each other, and axes of the plurality of heat exchange tubes G of each row are located in a same plane such as a horizontal plane in FIG. 1.

The heat exchanger 100 according to embodiments of the present invention may have any appropriate number (not less than 3) of rows of heat exchange tubes G. Advantageously, an uppermost row of the at least three rows includes N heat exchange tubes G, an intermediate row immediately below the uppermost row includes N+1 heat exchange tubes G, and any row between the intermediate row and a lowermost row of the at least three rows includes $2^{(i-2)}N+1$ heat exchange tubes G, where N is a positive integer not less than 1, and i is a positive integer not less than 3.

In the following description, the heat exchanger 100 having three rows of the heat exchange tubes G is taken as an example for explanation, and for the sake of clarity, the uppermost row of the three rows is referred to as the first row 110, the middle row of the three rows is referred to as the second row 120, and the lowermost row of the three rows is referred to as the third row 130.

Figure 7:
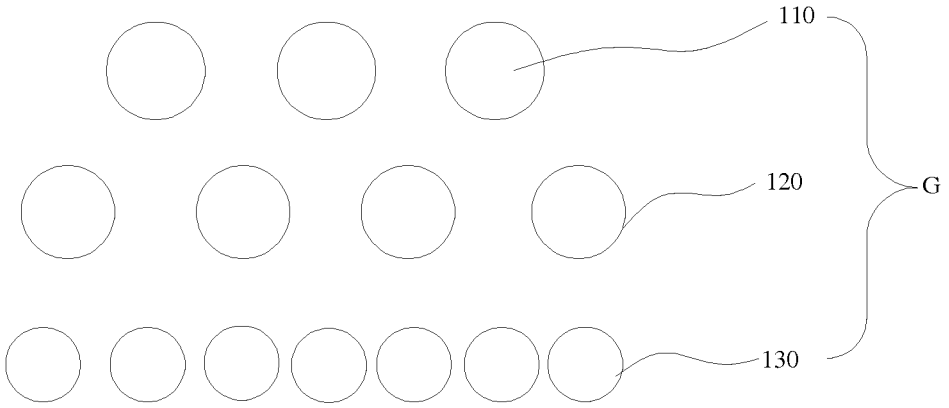
FIG. 7 is an illustration of an arrangement of three rows of heat exchange tubes of a heat exchanger shell enclosure according to an embodiment of the present invention.
Figure 8:
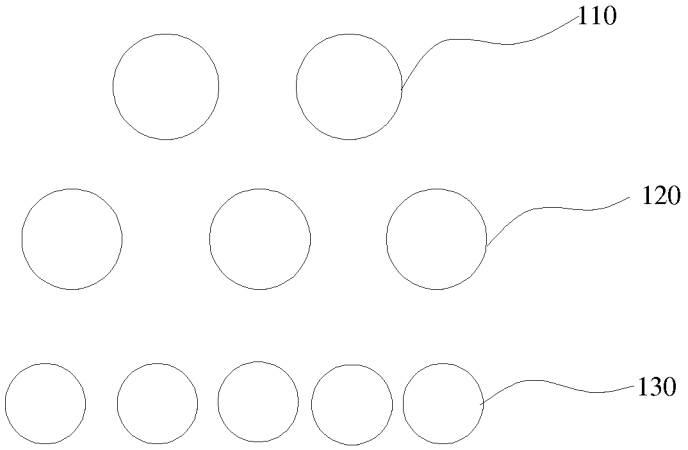
FIG. 8 is an illustration of an arrangement of three rows of heat exchange tubes of a heat exchanger according to another embodiment of the present invention.

As shown in FIGS. 1-2 and 7, by way of example and without limitation, the first row 110 includes three heat exchange tubes G, the second row 120 includes four heat exchange tubes G, and the third row 130 includes seven heat exchange tubes G. Alternatively, as shown in FIG. 8, the first row 110 includes two heat exchange tubes G, the second row 120 includes three heat exchange tubes G, and the third row 130 include five heat exchange tubes G.

The first row 110, the second row 120 and the third row 130 are arranged in the up and down direction and spaced apart from each other, as shown in FIG. 1. The two heat exchange shell enclosures 140 are disposed at two ends of the heat exchange tubes G. For the sake of clarity, the heat exchange shell enclosure 140 at a back end is referred to as a back heat exchange shell enclosure, and the heat exchange shell enclosure 140 at a front end is referred to as a front heat exchange shell enclosure.

The back heat exchange shell enclosure 140 communicates the left ends (leaving-tube-ends) of the heat exchange tubes G in the first row 110 with the left ends (entering-tube-ends) of the heat exchange tubes G in the second row 120, and the front heat exchange shell enclosure 140 communicates the right ends (leaving-tube-ends) of the heat exchange tubes G in the second row 120 with the right ends (entering-tube-ends) of the heat exchanged tubes G in the third row 130, thus connecting the heat exchange tubes G in the first row 110, the second row 120 and the third row 130 end to end in turn to define the substantially serpentine flue gas passage.

For example, when the heat exchanger 100 is applied to a gas-fired furnace, the right ends of the heat exchange tubes G in the first row 110 can be used as the flue gas inlet of the heat exchanger 100, and the left ends of the heat exchange tubes Gin the third row 130 can be used as the flue gas outlet of the heat exchanger 100.

In some embodiments, as shown in FIGS. 7 and 8, the heat exchange tubes G in the first row 110 and the second row 120 are disposed in a staggered fashion. Thus, the heat transfer at an airside of the heat exchange tubes G in the first row 110 can be strengthened by the unstable wake flow generated after air flows through the heat exchange tubes G in the second row 120.

Further, some heat exchange tubes G in the third row 130 are disposed staggerly relative to the heat exchange tubes G in the second row 120, and the remaining heat exchange tubes G in the third row 130 are aligned with the heat exchange tubes G in the second row 120 in the up and down direction. Thus, the heat transfer at the airside of the heat exchange tubes G in the second row 120 can be strengthened by the unstable wake flow generated after air flows through the heat exchange tubes G in the third row 130, thus improving the heat exchange efficiency.

Specifically, as shown in FIG. 7, the three heat exchange tubes G in the first row 110 is disposed staggerly relative to the four heat exchange tubes G in the second row 120. Four heat exchange tubes G in the third row 130 are aligned with the four heat exchange tubes G in the second row 120, and the remaining three heat exchange tubes G in the third row 130 are disposed staggerly relative to the four heat exchange tubes G in the second row 120.

As shown in FIG. 8, two heat exchange tubes G in the uppermost row 110 are disposed staggerly relative to the three heat exchange tubes G in the middle row 120. Three heat exchange tubes G in the lowermost row 130 are aligned with the three heat exchange tubes G in the middle row 120 in the up and down direction, and the remaining two heat exchange tubes G in the lowermost row 130 are disposed staggerly relative to the three heat exchange tubes G in the middle row 120.

In some embodiments, in order to reduce the manufacturing cost, the heat exchange tube G may be configured as a circular tube having a circular cross section. In order to satisfy the requirements of the heat transfer efficiency and the total heat transfer area, a diameter of the heat exchange tube G in one row is different from that of the heat exchange tube G in a next row.

Advantageously, when the heat exchanger is mounted in the gas-fired furnace, diameters of the heat exchange tubes G in different rows decrease progressively along the flue gas flow direction. By way of example and without limitation, in two adjacent rows, a ratio of a diameter of the heat exchange tube G in an upper row to a diameter of the heat exchange tube G in a lower row ranges from about 1.0 to about 1.5. Thus, by assembling the heat exchange tubes G with different diameters, the flow velocity of flue gas in the heat exchange tubes G can be controlled, such that a desired heat exchanging efficiency in the heat exchange tubes G at low temperature can be achieved.

Alternatively, the heat exchange tube G may be a tube having an elliptical cross section, and a cross sectional area of the heat exchange tube G in one row is different from that of the heat exchange tube G in a next row. Advantageously, a ratio between major and minor axes of the elliptical cross section of heat exchange tube G is at least 1.2.

In two adjacent rows, a ratio of a length of a major axis of the elliptical cross section of the heat exchange tube G in an upper row to a length of a major axis of the elliptical cross section of the heat exchange tube G in a lower row ranges from about 1.0 to 1.5, and a ratio of a length of a minor axis of the elliptical cross section of the heat exchange tube G in the upper row to a minor axis of the elliptical cross section of the heat exchange tube G in the lower row ranges from about 1.0 to about 1.5.

Advantageously, a ratio of a length L of the heat exchange tube G in any row to a distance H between an axis L1 of the exchange tube G in the uppermost row and an axis L2 of the heat exchange tube G in the lowermost row is greater than 2.0. The length of the heat exchanger in the gas-fired furnace is generally limited by the standard length of the gas-fired furnace. Therefore, the heat exchanger having a reduced height according to embodiments of the present invention enables the compactness and the reduced height of the gas-fired furnace.

Compared with the circular tube, a loss of a flow pressure of the air flowing through an outer surface of the elliptical heat exchange tube is low, and the air flow resistance is small, thereby improving the heat transfer efficiency. A ratio between the ventilation quantity and the power consumption of the motor of the air ventilation fan is an important performance index of the gas-fired furnace. The greater the ratio between the ventilation quantity and the power consumption of the motor of the air ventilation fan is, the smaller the air flow resistance is and/or the more efficient the air ventilation fan is. When the heat exchanger is used in the gas-fired furnace, the flow direction of the air outside the heat exchange tubes G is substantially parallel to the major axis of the cross section of the elliptical tube.

Advantageously, a turbulator (not shown) is disposed in any row of the heat exchange tubes G except an uppermost row of heat exchange tubes G, and a ratio of a length of the turbulator to a length L of the heat exchange tube G is not greater than 0.8. Thus, the heat exchange tubes G without the turbulator can be used to strengthen the heat transfer, thereby improving the heat exchange efficiency.

As shown in FIGS. 1-6, In some embodiments, the heat exchange shell enclosure 140 includes a base casing 141 and a cover casing 142, the cover casing 142 is engaged with the base casing 141 to define a communicating chamber, and the heat exchange tubes G are connected with corresponding base casings 141, such that the adjacent rows of heat exchange tubes are communicated with each other via the communicating chamber. In other words, the at least three rows of heat exchange tubes are connected end to end in turn via the communicating chamber.

Specifically, the heat exchange tubes G extend through and connect with the base casing 141 so as to communicate with the communicating chamber defined by the base casing 141 and the cover casing 142. The base casing 141 and the cover casing 142 may be welded together. Advantageously, the base casing 141 and the cover casing 142 are connected detachably via a bolt. Alternatively, a flanged edge is formed at a periphery of at least one of the base casing 141 and the cover casing 142, and the base casing 141 and the cover casing 142 are secured together via the flanged edge.

As shown in FIG. 1 and FIG. 2, in some embodiments, the base casing 141 is substantially plate-shaped, and the cover casing 142 is substantially mussel-shaped. Connecting holes 1411 are formed in the base casing 141, and ends of the heat exchange tubes G are matched in the connecting holes 1411. Advantageously, a flanged edge 1412 for supporting the heat exchange tube G additionally is formed at a periphery of each of the connecting holes 1411 and extended outwards (i.e., towards the communicating chamber), thus avoiding to break the outer circumferential walls of the connecting holes 1411.

As shown in FIGS. 1 and 2, the left ends of the heat exchange tubes G in the first row 110 and the second row 120 extend through and connect with the base casing 141 of the back heat exchange shell enclosure 140, such that the back heat exchange shell enclosure 140 communicates the left ends of the heat exchange tubes G in the first row 110 with the left ends of the heat exchange tubes G in the second row 120. The right ends of heat exchange tubes G in the second row 120 and the third row 130 extend through and connect with the base casing 141 of the front heat exchange shell enclosure 140, such that the front heat exchange shell enclosure 140 communicates the right ends of the heat exchange tubes G in the second row 120 with the right ends of the heat exchange tubes G in the third row 130.

As shown in FIGS. 1-5, In some embodiments, the cover casing 142 of each heat exchange shell enclosure 140 has an arched top wall 1421 (i.e., the left side wall of the cover casing 142 of the back heat exchange shell enclosure 140, or the right side wall of the cover casing 142 of the front heat exchange shell enclosure 140), thus facilitating the direction change of the air flow in the communicating chamber.

Advantageously, arch heights of the arch top walls 1421 of the cover casings 142 of the heat exchange shell enclosures 140 are different from each other. The term "arch height" here refers to a distance S from the top point of the arched top wall 1421 to a plane in which the periphery of the arched top wall 1421 is located. Advantageously, when the heat exchanger 100 is mounted in the gas-fired furnace, the flue gas flows along a serpentine path from up to down. In order to avoid the fact that the high-temperature flue gas from the heat exchange tubes G in the first row 110 causes hot spots on the arched top walls 1421 of the cover casings 142 of the heat exchange shell enclosures 140, the arch height of the arched top wall 1421 of the cover casing 142 of the back heat exchange shell enclosure 140 communicating the heat exchange tubes G in the second row 120 and the first row 110 is larger than the arch height of the arched top wall 1421 of the cover casing 142 of the front heat exchange shell enclosure 140 communicating the heat exchange tubes G in the third row 130 and the second row 120.

As the arch height of the arched top wall 1421 of the cover casing 142 of the front heat exchange shell enclosure 140 connecting the heat exchange tubes G in the third row 130 and the second row 120 is relatively small, a good heat transfer efficiency can be obtained at the flue gas outlet side, and it is favorable for a temperature switch in the gas-fired furnace to sense an overheating signal when the air ventilation fan fails to work or an air output of the air ventilation fan is insufficient, such that corresponding safety controls can be performed. Herein, the arch height of the arched top wall 1421 of the cover casing 142 is related to the flow velocity of flue gas, the heat transfer efficiency and the surface temperature control of the heat exchange shell. In other words, along the flue gas flow direction, the arch height of the arched top wall 1421 of the cover casing 142 of the heat exchange shell enclosure 140 located upstream is larger than the arch height of the arched top wall 1421 of the cover casing 142 of the heat exchange shell enclosure 140 located downstream.

In some embodiments, shapes of the arch top walls 1421 of the cover casings 142 may be different from each other. Advantageously, ribs 1423 having a predetermined length are formed on an inner wall surface of the arched top wall 1421 so as to define guide grooves, for splitting and guiding the air flow in the communicating chamber. Advantageously, each of the ribs 1423 is formed by recessing a portion of the top wall of the cover casing 142 inwards, for example, by means of stamping.

Figure 5:
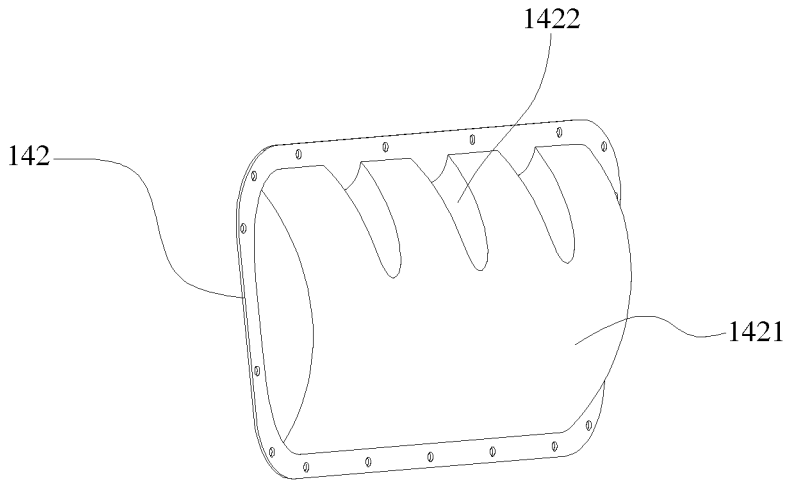
FIG. 5 is a schematic view of an outer wall surface of another cover casing of the heat exchanger shell enclosure according to an embodiment of the present invention.
Figure 6:
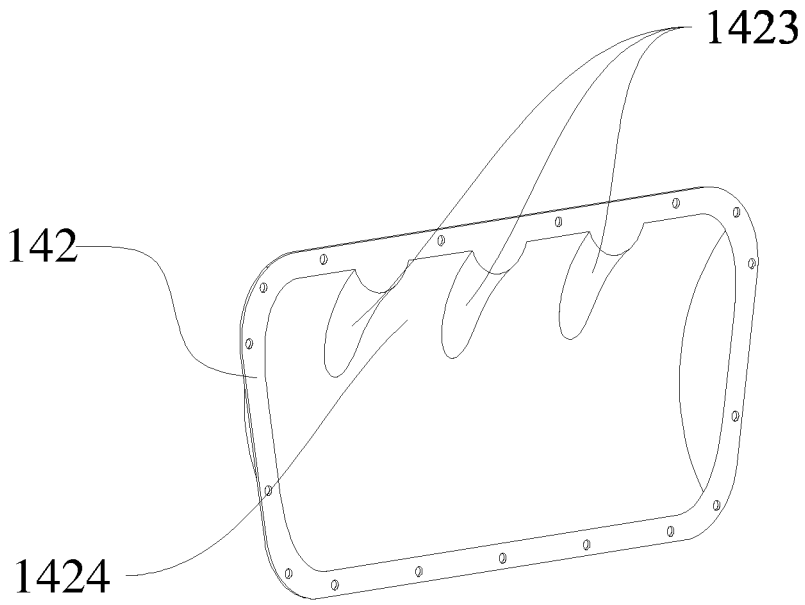
FIG. 6 is a schematic view of an inner wall surface of another cover casing of the heat exchanger shell enclosure according to an embodiment of the present invention.

Specifically, FIG. 5 and FIG. 6 show the front heat exchange shell enclosure 140 communicating the heat exchange tubes G in the third row 130 with the heat exchange tubes G in the second row 120. Three ribs 1423 are formed on the inner wall surface of the arched top wall 1421 of the cover casing 142 of the front heat exchange shell enclosure 140. More specifically, the ribs 1423 have the preset length extended downwards from an upper edge of the inner wall surface of the arched top wall 1421.

Figure 3:
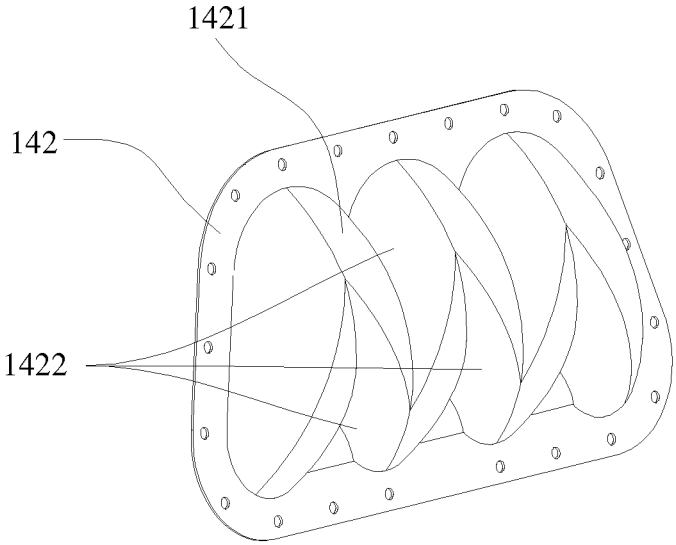
FIG. 3 is a schematic view of an outer wall surface of a top wall of one cover casing of the heat exchanger according to an embodiment of the present invention.
Figure 4:
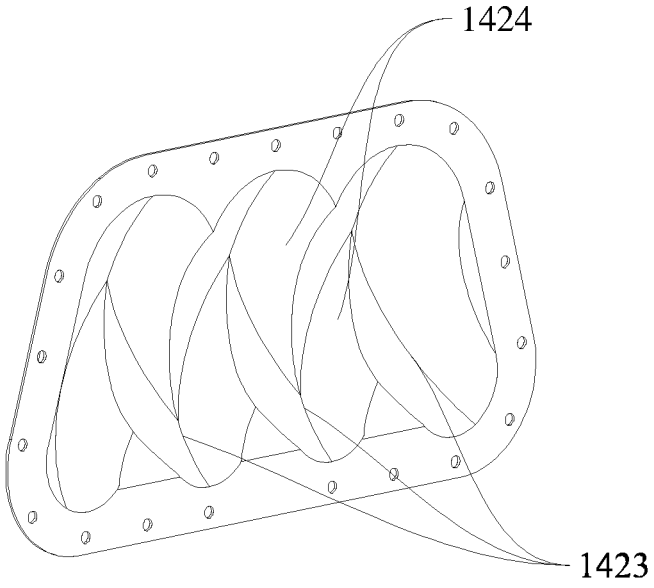
FIG. 4 is a schematic view of an inner wall surface of a cover casing of the heat exchanger shell enclosure according to an embodiment of the present invention.

FIG. 3 and FIG. 4 show the cover casing 142 of the back heat exchange shell enclosure 140 communicating the heat exchanging tubes G in the first row 110 with the heat exchange tubes G in the second row 120. As shown in FIG. 3 and FIG. 4, three arched ribs 1423 are formed on the inner wall surface of the arched top wall 1421 of the cover casing 142, thus facilitating guiding the flue gas flow from the heat exchange tubes G in the first row 110 to the heat exchange tubes G in the second row 120, avoiding causing the hot spot on the top wall 1421 of the cover casing 142, and making the inner surface of the heat exchange shell enclosure impacted by the flue gas have sufficient heat transfer efficiency.

As shown in FIG. 3, in order to form the ribs 1423 on the inner wall surface of the arched top wall 1421, grooves 1422 are formed in the outer wall surface of the top wall 1421, for example, by stamping, thereby forming the ribs 1423 on the inner wall surface of the arched top wall 1421. Guide grooves 1424 for guiding the flue gas flow are defined between the ribs 1423, and surfaces of the guide grooves 1424 can effectively approach the flue gas flow, thus facilitating the heat exchange. In FIG. 3 and FIG. 4, three guide grooves 1424 are shown, but the present invention is not limited to this.

As shown in FIG. 3 and FIG. 4, the ribs 1423 include a plurality of upper ribs extended downwards from the upper edge of the top wall and a plurality of lower ribs extended upwards from a lower edge of the top wall, and the upper ribs and the lower ribs are arranged in a staggered fashion. In some embodiments, the upper ribs and the lower ribs have a substantially triangular cross section, a cross sectional area of each of the upper ribs decreases gradually from up to down, and a cross sectional area of each of the lower ribs decreases gradually from down to up.

Figure 9:
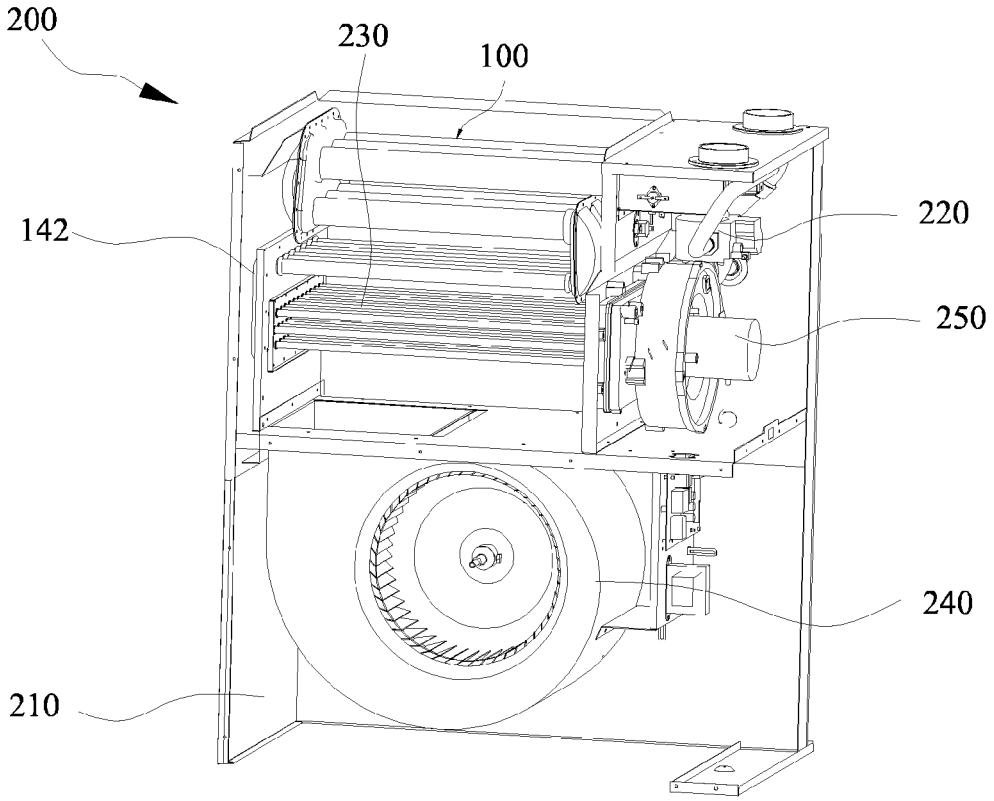
FIG. 9 is a schematic view of a gas-fired furnace according to an embodiment of the present invention.
Figure 10:
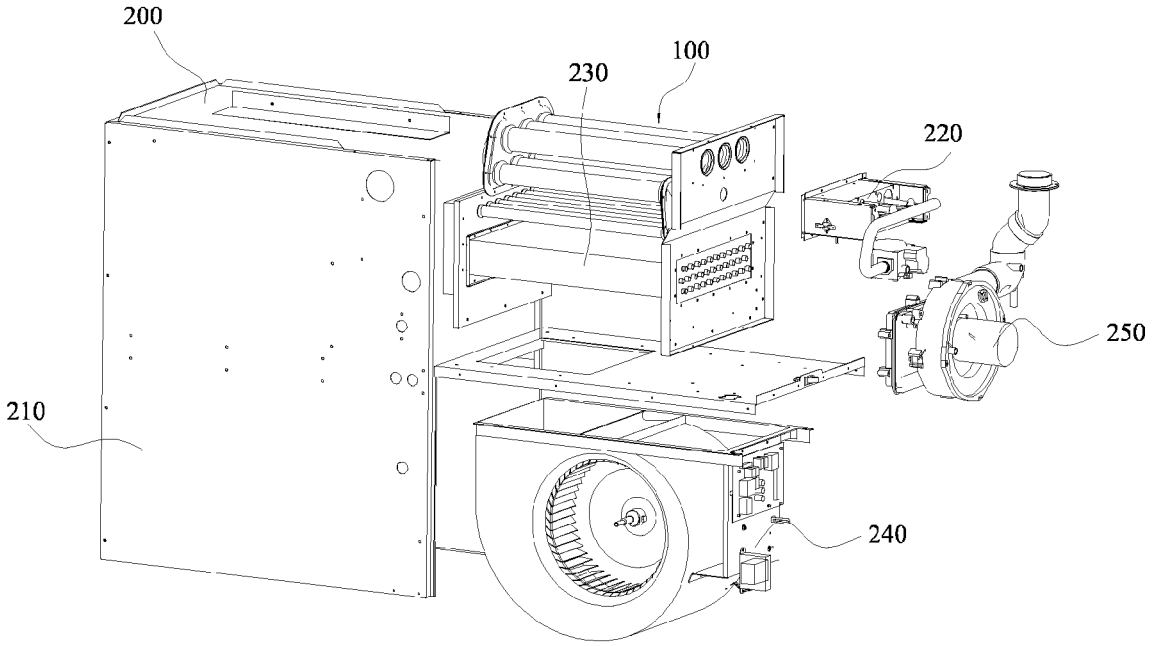
FIG. 10 is a schematic exploded view of a heat exchanger according to an embodiment of the present invention.

The gas-fired furnace 200 according to embodiments of the present invention will be described below with reference to FIGS. 9 and 10.

The gas-fired furnace 200 according to embodiments of the present invention includes a furnace body 210, a burner 220 disposed in the furnace body 210, a heat exchanger connected with an outlet of the burner 220, a secondary coil 230 connected with the heat exchanger described above, an air ventilation fan 240 disposed below the secondary coil 230, and a flue gas inducer 250 disposed at a side of the secondary coil 240.

With the gas-fired furnace according to embodiments of the present invention, the heat exchanger has a compact structure. The compact heat exchanger allows an enough distance between the secondary coil and the outlet of the gas-fired furnace that is beneficial for the ventilation fan to spread air flow more uniformly onto the windward side of the secondary coil, thus improving the heat transfer efficiency and reducing the fanning resistance.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom", "peripheral" as well as derivative thereof (e.g., "horizontally", "downwardly", "upwardly", etc.) should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance. Thus, the feature defined with "first" and "second" may comprise one or more this feature. In the description, "a plurality of" means two or more than two, unless specified otherwise.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

In the description of the present invention, a structure in which a first feature is "on" a second feature may include an embodiment in which the first feature directly contacts the second feature, and may also include an embodiment in which an additional feature is formed between the first feature and the second feature so that the first feature does not directly contact the second feature, unless specified otherwise. Furthermore, a first feature "on," "above," or "on top of" a second feature may include an embodiment in which the first feature is right "on," "above," or "on top of" the second feature, and may also include an embodiment in which the first feature is not right "on," "above," or "on top of" the second feature, or just means that the first feature is at a height higher than that of the second feature. While a first feature "beneath," "below," or "on bottom of" a second feature may include an embodiment in which the first feature is right "beneath," "below," or "on bottom of" the second feature, and may also include an embodiment in which the first feature is not right "beneath," "below," or "on bottom of" the second feature, or just means that the first feature is at a height lower than that of the second feature.

Reference throughout this specification to "an embodiment", "some embodiments", "one embodiment", "an example", "a specific examples", or "some examples" means that a particular feature, structure, material, or characteristic described in connection with the embodiment or example is included in at least one embodiment or example of the invention. Thus, the appearances of the phrases such as "in some embodiments", "in one embodiment", "in an embodiment", "an example", "a specific examples", or "some examples" in various places throughout this specification are not necessarily referring to the same embodiment or example of the invention. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the invention. Such changes, alternatives, and modifications all fall into the scope of the claims and their equivalents.

What is claimed is:

1. A heat exchanger, comprising:

at least two heat exchange shell enclosures;

at least three rows of heat exchange tubes arranged along a furnace air flow path, wherein each of the heat exchange tubes defines a leaving-tube-end and an entering-tube-end, two adjacent rows of the at least three rows of heat exchange tubes being spaced from each other, the at least three rows of heat exchange tubes including a first row, a second row, and a third row, the first row connected in a leaving-tube-end to an entering-tube-end of the second row via a first of the at least two heat exchange shell enclosures, the second row connected in a leaving-tube-end to an entering-tube-end of the third row via a second of the at least two heat exchange shell enclosures such that the at least three rows of heat exchange tubes and the at least two heat exchange shell enclosures define a substantially serpentine flue gas passage that is configured to be downstream of a burner; and wherein each of the at least two heat exchange shell enclosures comprises a base casing and a cover casing, the cover casing is engaged with the base casing to define a communicating chamber, and the heat exchange tubes are connected with corresponding base casings such that the adjacent rows of heat exchange tubes are communicated with each other via the communicating chamber.

2. The heat exchanger according to claim 1, wherein the heat exchange tubes are generally parallel to each other, and the heat exchange tubes in two adjacent rows are disposed in a staggered fashion.

3. The heat exchanger according to claim 1, wherein the cover casing has an arched top wall, and arch heights of the arched top walls of the cover casings of the at least two heat exchange shell enclosures are different from each other.

4. The heat exchanger according to claim 1, wherein shapes of the arched top walls of the cover casings of the at least two heat exchange shell enclosures are different from each other.

5. The heat exchanger according to claim 1, wherein ribs having a predetermined length are formed on an inner wall surface of the arched top wall so as to define guide grooves.

6. The heat exchanger according to claim 5, wherein each of the ribs is formed by recessing a portion of the top wall of the cover casing inwards.

7. The heat exchanger according to claim 5, wherein the ribs comprise a plurality of upper ribs extended downwards from an upper edge of the top wall and a plurality of lower ribs extended upwards from a lower edge of the top wall, and the upper ribs and the lower ribs are arranged in a staggered fashion.

8. The heat exchanger according to claim 7, wherein the upper and lower ribs have a substantially triangular cross section, a cross sectional area of each of the upper ribs decreases gradually from up to down, and a cross sectional area of each of the lower ribs decreases gradually from down to up.

9. The heat exchanger according to claim 1, wherein connecting holes are formed in the base casing for connecting with the heat exchange tubes, a flanged edge is formed at a periphery of each of the connecting holes, and the base casing and the cover casing are connected detachably via a bolt.

10. The heat exchanger according to claim 1, wherein a plurality of heat exchange tubes are arranged in each row, and axes of the heat exchange tubes in each row are in a same plane.

11. The heat exchanger according to claim 1, wherein an uppermost row of the at least three rows comprises N heat exchange tubes, an intermediate row immediately below the uppermost row comprises N+1 heat exchange tubes, and any row between the intermediate row and a lowermost row of the at least three rows comprises 2(i−2) N+1 heat exchange tubes, where N is a positive integer not less than 1, and i is a positive integer not less than 3.

12. The heat exchanger according to claim 1, wherein three rows of heat exchange tubes are disposed, the heat exchange tubes in an uppermost row and an intermediate row are disposed in a staggered fashion, wherein some heat exchange tubes in a lowermost row are disposed staggerly relative to the heat exchange tubes in the middle row, and the remaining heat exchange tubes in the lowermost row are aligned with corresponding heat exchange tubes in the middle row.

13. The heat exchanger according to claim 1, wherein the heat exchange tube has a circular cross section, and a diameter of the heat exchange tube in one row is different from that of the heat exchange tube in a next row.

14. The heat exchanger according to claim 13, wherein, in two adjacent rows, a ratio of a diameter of the heat exchange tube in an upper row to a diameter of the heat exchange tube in a lower row ranges from about 1.0 to about 1.5.

15. The heat exchanger according to claim 1, wherein the heat exchange tube has an elliptical cross section, and a cross sectional area of the heat exchange tube in one row is different from that of the heat exchange tube in a next row.

16. The heat exchanger according to claim 15, wherein a ratio of major and minor axes of the elliptical cross section of the heat exchange tube is at least 1.2, in two adjacent rows, a ratio of a major axis of the elliptical cross section of the heat exchange tube in an upper row to a major axis of the elliptical cross section of the heat exchange tube in a lower row ranges from about 1.0 to about 1.5, and a ratio of a minor axis of the elliptical cross section of the heat exchange tube in the upper row to a minor axis of the elliptical cross section of the heat exchange tube in the lower row ranges from about 1.0 to about 1.5.

17. The heat exchanger according to claim 1, wherein a ratio of a length of the heat exchange tube in any row to a distance between an axis of the heat exchange tube in an uppermost row and an axis of the heat exchange tube in a lowermost row is greater than 2.0.

18. The heat exchanger according to claim 1, wherein a turbulator is disposed in any row of the heat exchange tubes except an uppermost row of heat exchange tubes, and a ratio of a length of the turbulator to a length of the heat exchange tube is not greater than 0.8.

19. A gas-fired furnace, comprising:

a furnace body;

a burner disposed in the furnace body;

a heat exchanger connected with an outlet of the burner, wherein the heat exchanger comprises at least two heat exchange shell enclosures;

at least three rows of heat exchange tubes arranged along a furnace air flow path, wherein each of the heat exchange tubes defines a leaving-tube-end and an entering-tube-end, two adjacent rows of the at least three rows of heat exchange tubes being spaced from each other, the at least three rows of heat exchange tubes including a first row, a second row, and a third row, the first row connected in a leaving-tube-end to an entering-tube-end of the second row via a first of the at least two heat exchange shell enclosures the second row connected in a leaving-tube-end to an entering-tube-end of the third row via a second of the at least two heat exchange shell enclosures such that the at least three rows of heat exchange tubes and the at least two heat exchange shell enclosures define a substantially serpentine flue gas passage that is downstream of the burner;

wherein each of the at least two heat exchange shell enclosures comprises a base casing and a cover casing, the cover casing is engaged with the base casing to define a communicating chamber, and the heat exchange tubes are connected with corresponding base casings such that the adjacent rows of heat exchange tubes are communicated with each other via the communicating chamber;

a secondary coil connected with the heat exchanger;

an air ventilation fan disposed below the secondary coil; and a flue gas inducer disposed at a side of the secondary coil.

20. A heat exchanger, comprising:

at least two heat exchange shell enclosures;

at least three rows of heat exchange tubes arranged along a furnace air flow path, wherein each of the heat exchange tubes defines a leaving-tube-end and an entering-tube-end, two adjacent rows of the at least three rows of heat exchange tubes being spaced from each other, the at least three rows of heat exchange tubes including a first row, a second row, and a third row, the first row connected in a leaving-tube-end to an entering-tube-end of the second row via a first of the at least two heat exchange shell enclosures, the second row connected in a leaving-tube-end to an entering-tube-end of the third row via a second of the at least two heat exchange shell enclosures such that the at least three rows of heat exchange tubes and the at least two heat exchange shell enclosures define a substantially serpentine flue gas passage that is configured to be downstream of a burner; and wherein three rows of heat exchange tubes are disposed, the heat exchange tubes in an uppermost row and an intermediate row are disposed in a staggered fashion, wherein some heat exchange tubes in a lowermost row are disposed staggerly relative to the heat exchange tubes in the middle row, and the remaining heat exchange tubes in the lowermost row are aligned with corresponding heat exchange tubes in the middle row.

* * * * *